United States Patent [19]

Berland

[11] Patent Number: 4,969,762

[45] Date of Patent: Nov. 13, 1990

[54] TYPEWRITER LABEL DISPENSING DEVICE

[76] Inventor: Maxine L. Berland, 659 Oak St., Lakewood, Colo. 80215

[21] Appl. No.: 280,332

[22] Filed: Dec. 6, 1988

[51] Int. Cl.[5] ..... B41J 15/10; B41J 29/16

[52] U.S. Cl. ..... 400/615.1; 400/529; 400/717; 400/679

[58] Field of Search ..... 400/238, 521, 522, 529, 400/530, 531, 613, 613.1, 615, 615.1, 622, 626, 718, 679, 717

[56] References Cited

U.S. PATENT DOCUMENTS

| | | | |
|---|---|---|---|
| 1,298,824 | 4/1919 | Taylor, Jr. | 400/238 |
| 2,080,986 | 5/1937 | Pierce | 400/615.1 |
| 2,971,628 | 2/1961 | Griffith | 400/615.1 |
| 3,399,754 | 9/1968 | Rooney | 400/238 |
| 3,810,536 | 5/1974 | Madore | 400/615.1 |
| 4,070,223 | 1/1978 | Stalzer | 400/530 X |
| 4,767,093 | 8/1988 | Jones | 400/718 X |

FOREIGN PATENT DOCUMENTS

| | | | |
|---|---|---|---|
| 0128886 | 8/1983 | Japan | 400/613 |
| 624493 | 6/1949 | United Kingdom | 400/615 |

OTHER PUBLICATIONS

IBM Technical Disclosure Bulletin, "Bimetallic Tape Capture/Release Mechanism", Graham, vol. 25 No. 3A, Aug. 1982, pp. 1144–1145.

*Primary Examiner*—Edgar S. Burr
*Assistant Examiner*—C. A. Bennett
*Attorney, Agent, or Firm*—Jerome J. Norris

[57] ABSTRACT

Non-adhesive label dispensing carton for providing a roll of perforated first-label-useful typewriter spaced labels from a rolled-up form from around a core in the carton, and wherein said carton is removably anchorable to the typewriter casing top.

3 Claims, 1 Drawing Sheet

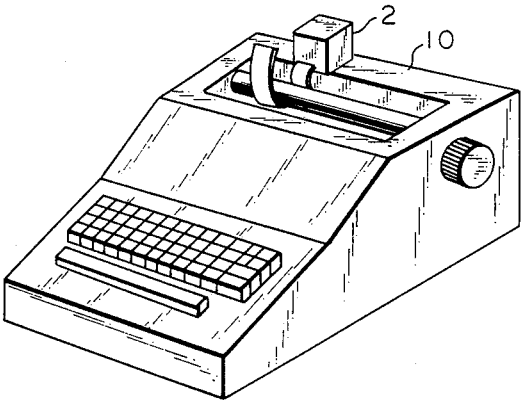
FIG. 1
FIG. 2
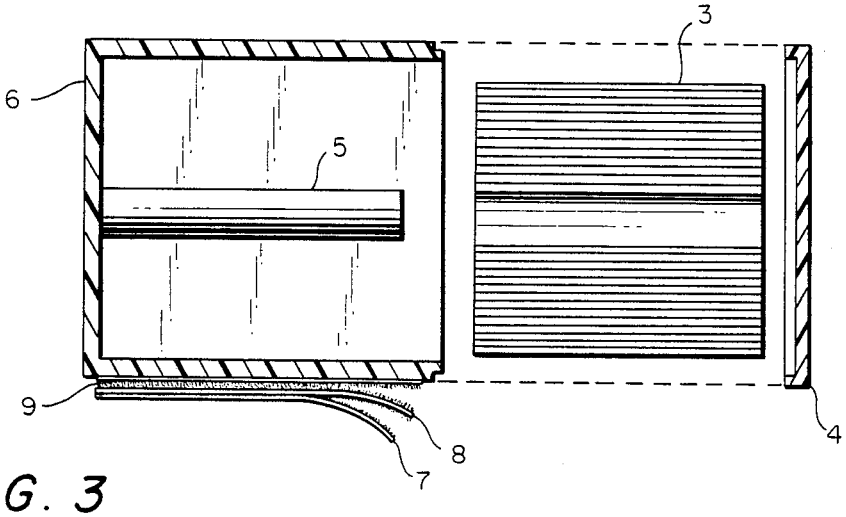
FIG. 3
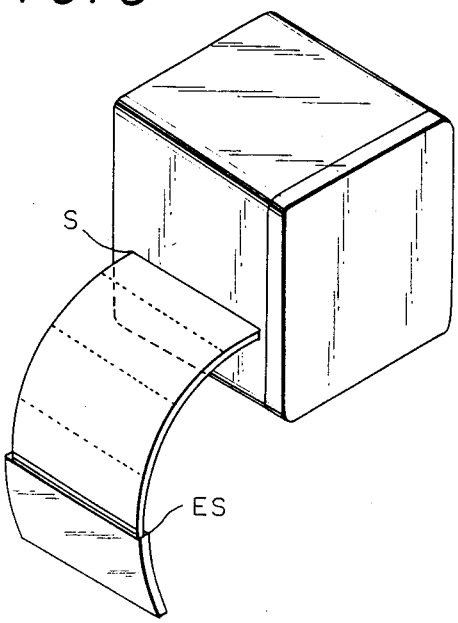
FIG. 4
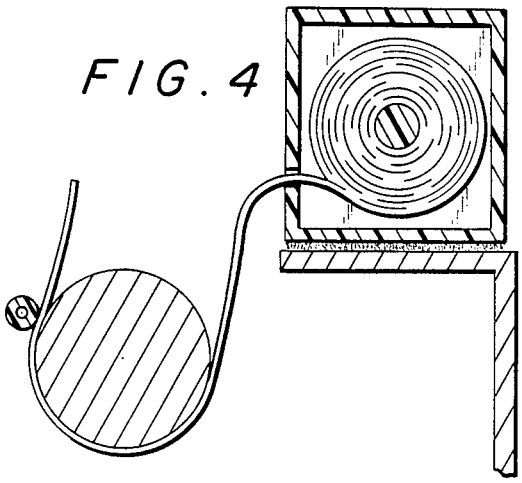

TYPEWRITER LABEL DISPENSING DEVICE

FIELD OF THE INVENTION

The present invention relates to a novel non-adhesive label dispensing device for providing a continuous roll of perforated typewriter-spaced labels from a rolled-up or wound form, from around a core in a carton, which is anchorable onto a typewriter casing.

BACKGROUND OF THE INVENTION

The first and last labels of a series of perforated prior art non-adhesive labels intended for insertion onto "see-thru" detachable plastic tabs for hanging folders, such as PENDAFLEX® grand hanging folders, are not usable.

Their non-usable aspect is due to the fact that, the first label serves as a guide or lead paper that is insertable by rotating the typewriter knobs to manipulate the label into position on the platen, for impacting by the typing disc. Moreover, in this arrangement, the first or lead label is not held tautly and in proper alignment on the platen, and, for this reason, the typing disc or sphere will not impact it properly. The last label is non-usable for the same reason.

Accordingly, there is a need in the art for a non-adhesive label dispensing device that is removably anchorable on the typewriter casing, and provides a continuous roll of perforated or scored typewriter-spaced labels, in which the first and last labels can be held tautly and in proper alignment on the typewriter platen to enable the typing sphere or disc to impact it properly, and thereby render the first and last labels usable.

A further need exists for a non-adhesive label dispensing device having means to allow a typed label to be torn-off, and yet the next succeeding label to be usable for typing in its new position as the first label, at a subsequent point in time.

SUMMARY OF THE INVENTION

One object of the present invention is to provide a non-adhesive label dispensing device for a continuous roll of perforated typewriter-spaced labels from a rolled-up or wound form, from around a core disposed in a carton, which is anchorable onto a typewriter casing.

Another object of the invention is to provide a non-adhesive label dispensing device that is removably anchorable on a typewriter casing, and provides a continuous roll of perforated typewriter-spaced labels, in which the initial and final label can be held tautly and in proper alignment on the typewriter platen to allow the typing sphere to impact it properly, and thereby render the initial and last labels usable.

A yet further object of the invention is to provide a non-adhesive label dispensing device having means to allow a typed label to be torn-off, and yet permit the next succeeding label to be usable for typing in its new position as the first label, at a later point in time.

The novel non-adhesive label dispensing device comprises, a carton containing a continuous roll of perforated typewriter-spaced non-adhesive labels wound around a core which can be permanently or removably attached to a non-removable side wall of the carton. A non-removable front wall of the carton has a horizontally disposed opening slit through which the label emerges when it is wound into the typewriter to be typed upon, and the first label from the roll is frictionally held in a plastic end sleeve, which serves as lead paper to guide the first label tautly in proper alignment on the platen for impaction from the typing disc. To hold the carton in a firm position on top of the typewriter case, one half of the back of a VELCRO attachment is adhesively bound to the bottom of the carton and the other mating half of the back of the velcro attachment is removably adhesively bound to the top of the typewriter case. Upon placing the VELCRO bottom of the carton in registry over the top of the VELCRO bound to the typewriter case, the carton becomes firmly anchored, and allows the label to remain taut as it is unwound for typing upon.

BRIEF DESCRIPTION OF THE DRAWINGS

FIG. 1 is a perspective view of a typewriter with the label dispensing carton anchored thereon, and showing the label in position for being typed upon.

FIG. 2 is an exploded view in section of the label dispensing carton showing the removable end wall and opening through which wound labels are inserted over a core.

FIG. 3 is a perspective view of the closed label dispensing carton showing perforated labels and the removable label holding end sleeve, which acts as the lead paper.

FIG. 4 is a partial side view in section of the combination of carton, typewriter case top and drum or platen under which the unrolled label is wound into ready position for typing.

DETAILED DESCRIPTION OF THE INVENTION

When the label dispensing carton 2, is ready to be loaded with a roll of non-adhesive labels 3, the side end wall 4, is removed and the wound roll 3 is inserted in the carton over a core 5, which is preferably permanently attached to the opposite non-removable side wall 6. The label roll 3 is the advanced through the front wall horizontal slit S, until the plastic end sleeve ES, and several perforated labels are exposed.

Upon closing the label-loaded carton, the carton is made ready for anchoring to the top of the typewriter casing by peeling a protective plastic strip or backing 7, away from the bottom of an adhesively coated strip 8, which has a VELCRO top that mates with the bottom of a VELCRO strip 9, that is bound to the bottom of the carton. After strip 8 is separated from VELCRO strip 9, the bottom of strip 8, which is adhesively coated, is placed in a removably adhered position on top of typewriter casing 10, and the carton is then placed directly over the casing-adhered-strip in order to mate the two VELCRO halves and removably anchor the carton on the typewriter casing.

After a few labels are typed-up, they can be torn-off at the perforation lines, and the plastic end sleeve can be removed and inserted over the new first appearing label in friction tight relationship to start the process over again. In order to ensure that the first label will be held in friction-tight relationship with the end sleeve that serves as lead or guide paper, the rectangular opening in the sleeve is made so that it tapers to a progressively lesser square area away from the sleeve opening.

The description has been set forth as illustrative only, and not by way of limitation, and many changes can be made in the invention description, without departing from the invention scope, which is defined by the claims.

What is claimed:

1. A typewriter label dispensing carton which is removably anchorable on a typewriter casing, and allows a first label of a perforated series of labels wound from said carton to be usable for typing upon, comprising:

a carton containing a roll of perforated typewriter spaced non-adhesive labels wound around a core within said carton; and a horizontally disposed slit opening in a front wall of said carton for removing said labels after placing same for unwinding in a typewriter platen by typewriter knob rotation; said carton having disposed on a bottom thereof, VELCRO means for removably anchoring the carton on the top of the casing of a typewriter; and wherein the first label of perforated series of labels has a plastic end sleeve removably attached thereto, which serves as a guide to allow the first label to be used for typing upon.

2. The typewriter label dispensing carton of claim 1, wherein the means for removably anchoring said carton on said typewriter casing are two mating VELCRO holders, and wherein the back of an upper VELCRO holder is permanently fixed to a bottom of said carton, and a back of a lower VeLcro holder is coated with an adhesive and is removably anchorable to the casing of the top of said typewriter.

3. The typewriter label dispensing carton of claim 2, further containing a protective strip to prevent adhesion of the backing of the lower Velcro holder.

* * * * *